US008708748B2

(12) United States Patent
Lin

(10) Patent No.: US 8,708,748 B2
(45) Date of Patent: Apr. 29, 2014

(54) ELECTRICAL CONNECTOR AND METHOD OF ASSEMBLING THE SAME

(75) Inventor: Min-Han Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 46 days.

(21) Appl. No.: 13/463,070

(22) Filed: May 3, 2012

(65) Prior Publication Data

US 2012/0282811 A1 Nov. 8, 2012

(30) Foreign Application Priority Data

May 4, 2011 (TW) ..... 100115632

(51) Int. Cl.
*H01R 24/00* (2011.01)

(52) U.S. Cl.
USPC ..... 439/626; 439/638; 439/607.55

(58) Field of Classification Search
USPC ..... 439/626, 638, 654, 607.55, 607.54, 439/607.24, 607.23
See application file for complete search history.

(56) References Cited

U.S. PATENT DOCUMENTS

| | | | | |
|---|---|---|---|---|
| 4,660,920 | A * | 4/1987 | Shibano | 439/631 |
| 5,190,481 | A * | 3/1993 | Ju | 439/654 |
| 5,599,595 | A * | 2/1997 | McGinley et al. | 428/33 |
| 6,364,713 | B1 | 4/2002 | Kuo | |
| 6,984,132 | B1 * | 1/2006 | Spalding et al. | 439/76.1 |
| 7,090,538 | B1 * | 8/2006 | Huang | 439/638 |
| 7,416,452 | B1 * | 8/2008 | Sabo | 439/631 |
| 8,075,343 | B2 * | 12/2011 | Fu et al. | 439/637 |
| 2010/0105249 | A1 * | 4/2010 | Bandhu et al. | 439/638 |
| 2010/0151743 | A1 * | 6/2010 | Zhou et al. | 439/651 |
| 2012/0282812 | A1 * | 11/2012 | Lin et al. | 439/638 |

* cited by examiner

*Primary Examiner* — Hae Moon Hyeon

(74) *Attorney, Agent, or Firm* — Ming Chieh Chang; Wei Te Chung

(57) ABSTRACT

An electrical connector assembly (100) comprises: a first insulative housing having a base portion (11) and a mating portion (12), and a second insulative housing (4) located on the base portion. The second insulative housing defines a body portion (41) and a tongue portion (42). A number of contacts (2) are formed in the first and second insulative housings. Each of the contact defines a first mating section (201) and a second mating section (202), and a curved connecting section connected with the first and second mating sections. A first metallic shell (3) encloses and engages with the first insulative housing. A second metallic shell (5) encloses the second insulative housing and engages with the first insulative housing. And, a metallic connecting piece (6) respectively connects with the first and second metallic shells.

20 Claims, 5 Drawing Sheets

ELECTRICAL CONNECTOR AND METHOD OF ASSEMBLING THE SAME

FIELD OF THE INVENTION

The present invention generally relates to an electrical connector and a method of assembling the same, and particularly the electrical connector concerns an adapter connector for transferring signals.

DESCRIPTION OF PRIOR ART

U.S. Pat. No. 6,364,713 issued to Kuo on Apr. 2, 2002 discloses an electrical connector adapter assembly. The electrical connector adapter assembly comprises a first dielectric housing, three sets of first terminals retained in the first dielectric housing, a printed circuit board (PCB), a second dielectric housing, and two sets of second terminals retained in the second dielectric housing. The first and second terminals are electrically connected with each other by the PCB. As the PCB is present in the electrical connector adapter assembly, the adapter assembly becomes large in its outline and will occupy a large space. On the other hand, as the first and second terminals are electrically connected with each other through the PCB, the signal may be attenuated during transmission.

Hence, an improved electrical connector is desired to overcome the disadvantages of the related art.

SUMMARY OF THE INVENTION

Accordingly, an object of the present invention is to provide an electrical connector having a simple structure and with a stability signal transmission.

In order to achieve the above-mentioned objects, an electrical connector assembly comprising: a first insulative housing having a base portion and a mating portion extending forwardly from the base portion; a second insulative housing located on the base portion of the first insulative housing, and having a body portion and a tongue portion extending rearwardly from the body portion; a plurality of contacts in the first and second insulative housings, each of the contacts defining a lower first mating section and an upper second mating section parallel to each other, and an intermediate curved connecting section connected with the first and second mating sections; a first metallic shell enclosing and engaged with the first insulative housing; a second metallic shell enclosing the second insulative housing and engaged with the first insulative housing; and a metallic connecting piece connected with the first and second metallic shells.

In order to achieve the above-mentioned objects, a method of assembling an electrical connector, comprising the steps of: providing a first insulative housing having a plurality first receiving slots, a base portion, and a mating portion; assembling a plurality of contacts to the first insulative housing, each contact defining a first mating section and a second mating section respectively formed at two ends thereof; inserting the plurality of first mating sections into corresponding first receiving slots; providing a second insulative housing having a plurality of second receiving slots, a body portion, and a tongue portion; assembling a second metallic shell to the second insulative housing, the second insulative housing enclosed by the second metallic, the second metallic shell defining a plurality of engaging pieces formed thereon; assembling a second insulative housing to the first insulative housing, the second insulative housing, the step of assembling including locating the body portion on the base portion, inserting the engaging pieces of the second metallic shell into the base portion of the first insulative housing, inserting the plurality of second mating sections into corresponding second receiving slots; assembling a first metallic shell to the first insulative housing, the first insulative housing enclosed by the first metallic shell, the first metallic shell defining a plurality of engaging pieces inserted into the base portion of the first insulative housing; providing a metallic piece having two connecting sections respectively attached to the first and second metallic shells; soldering the two connecting sections to the first and second metallic shells.

Other objects, features and advantages of the invention will be apparent from the following detailed description taken in connection with the accompanying drawings.

DETAILED DESCRIPTION OF PREFERRED EMBODIMENTS

Figure 1:
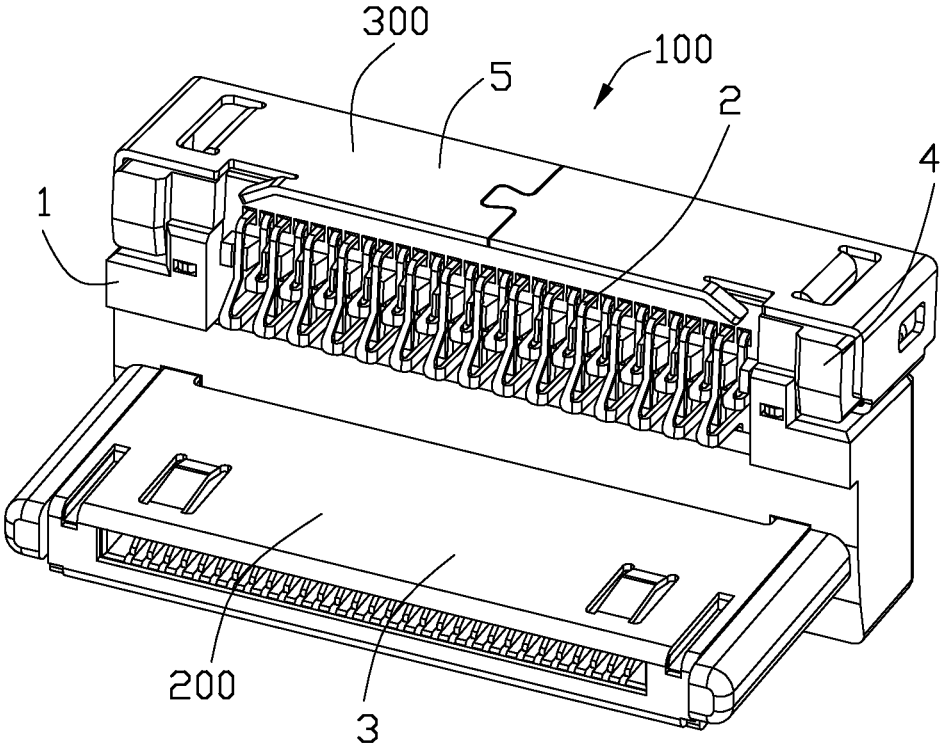
FIG. 1 is a perspective view of an electrical connector assembly in accordance with the present invention.

Reference will now be made to the drawing figures to describe the present invention in detail.

Figure 2:
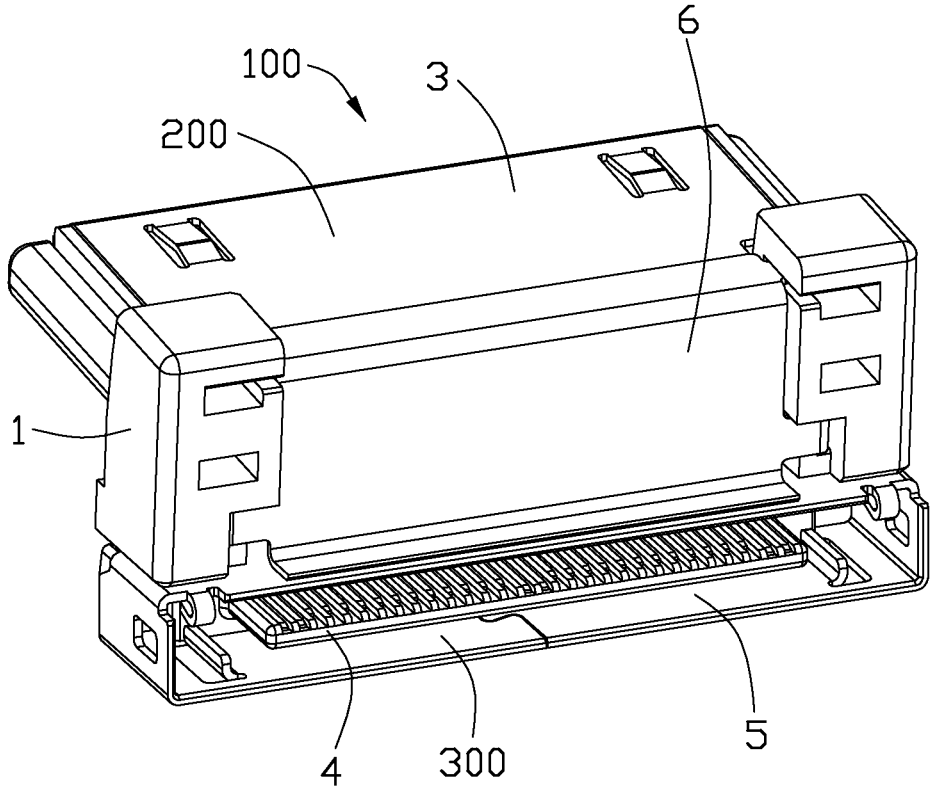
FIG. 2 is another perspective view of the electrical connector in accordance with the present invention.

FIGS. 1 to 2 illustrate perspective views of an electrical connector assembly 100 made in accordance with the present invention. The electrical connector assembly 100 defines a plug portion 200 and a receptacle portion 300 for signal transferring between two electrical devices (not shown). In this embodiment, the electrical connector 100 comprises a first insulative housing 1 and a second insulative housing 4 assembled with each other, and a plurality of contacts received into the first and second housing 1, 4.

Figure 3:
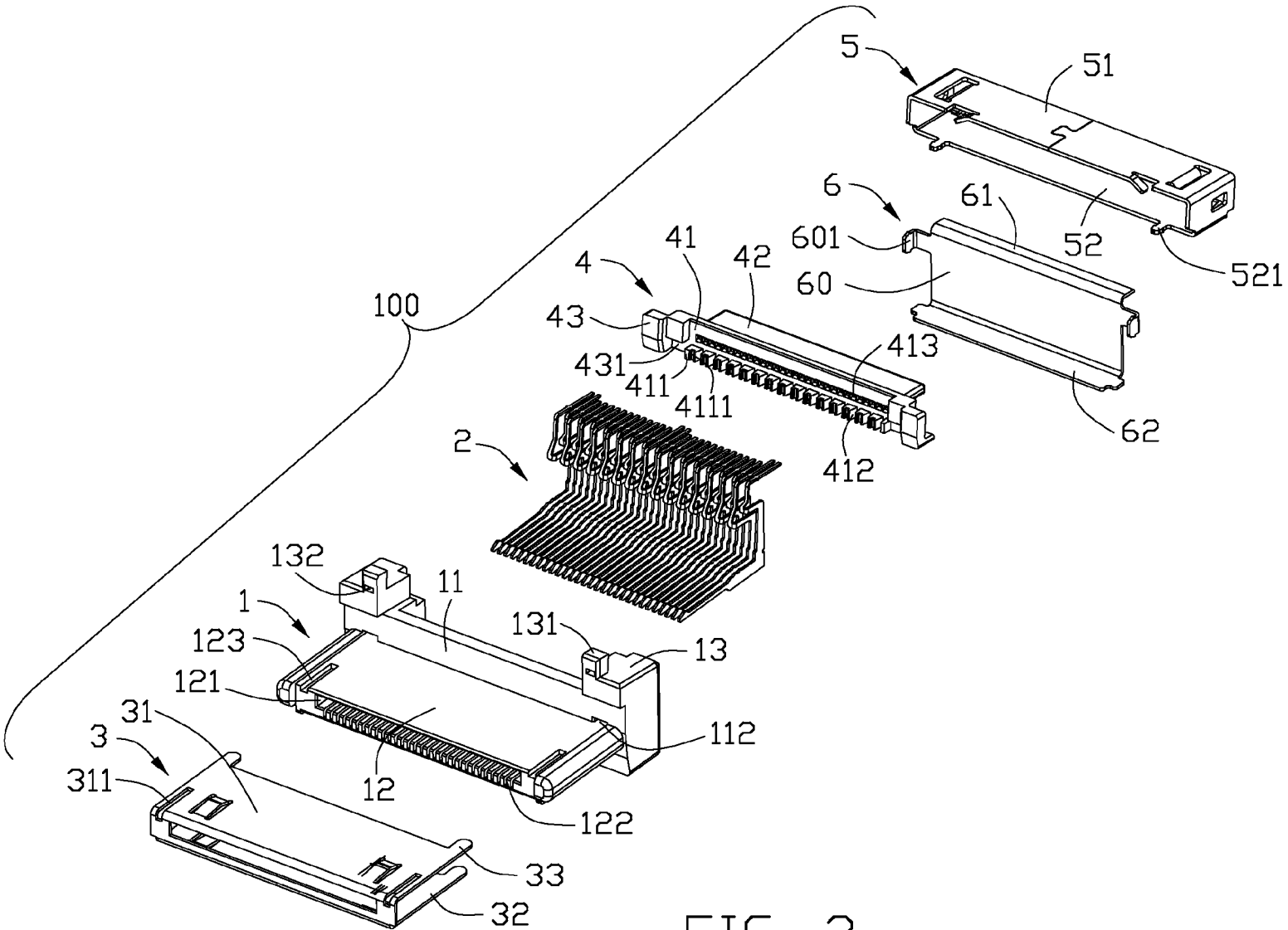
FIG. 3 is an exploded, perspective view of the electrical connector assembly of FIG. 1.
Figure 4:
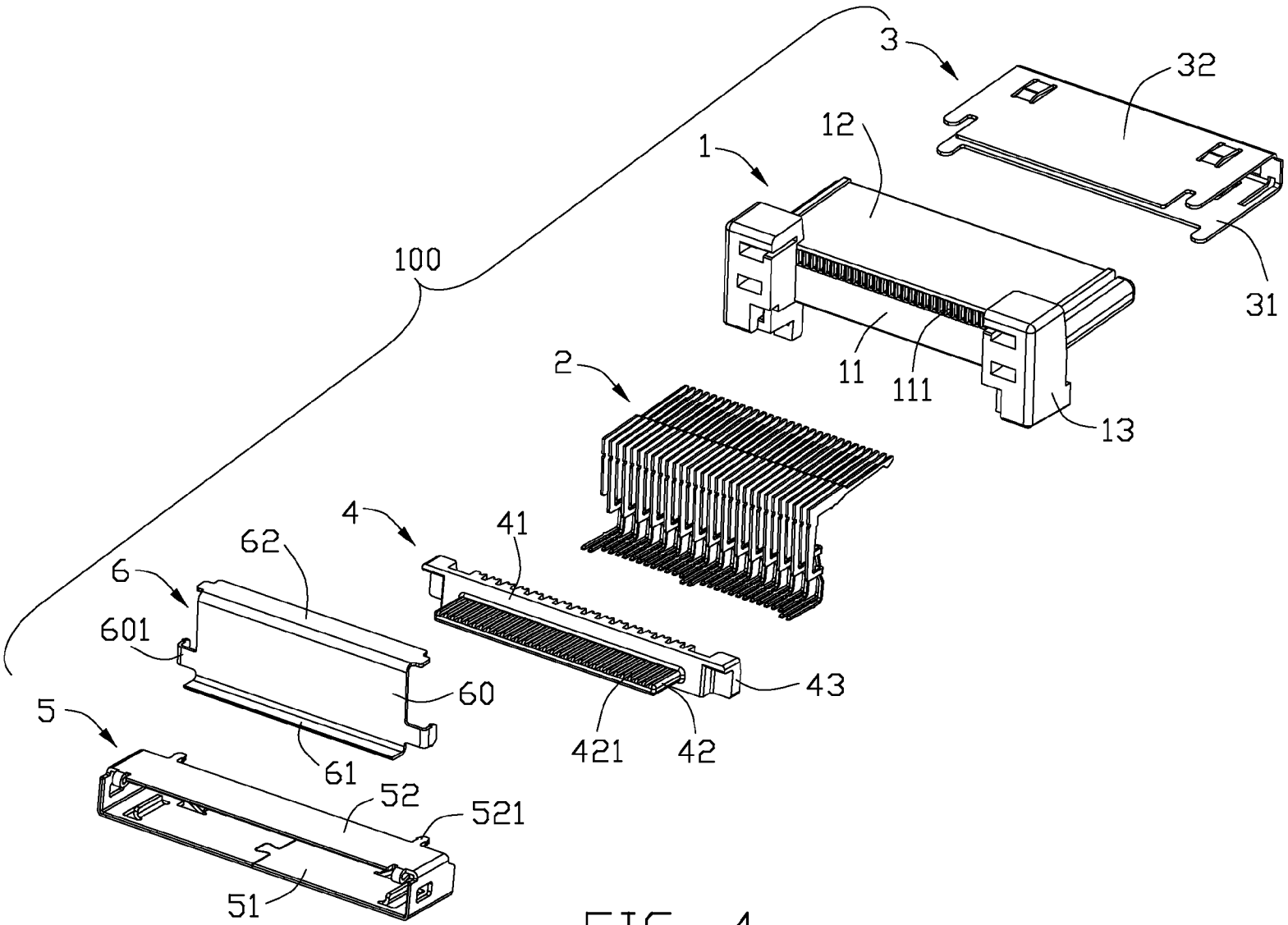
FIG. 4 is similar to FIG. 3, but viewed form another aspect.

Referring to FIGS. 3 to 4, the insulative housing 1 comprises a base portion 11 and a mating portion 12 extending forwardly from a front surface of the base portion 11. The first insulative housing 1 defines four apertures 112 formed on a front surface thereof. The mating portion 12 of the first insulative housing 1 defines a receiving room 121, and a plurality of first receiving slots 122 formed on an inner surface of the receiving room 121 and communicated with the receiving room 121. The first receiving slots 122 extend rearwardly to a rear surface of the base portion 11. Thus, a plurality of first openings 111 are formed on the rear surface of the base portion 11. The mating portion 12 defines a pair of flutes 123 formed at two sides of a top surface thereof. The base portion 11 defines two mounting sections 13 formed at two sides of the base portion 11 along a transversal direction. Each of the mounting section 13 has a protrusion 131 formed on a top end thereof. The protrusion 131 defines a slot 132 throughout the protrusion 131 along a front to rear direction. The second insulative housing 4 is assembled to the first insulative housing 1 along an up to down direction. The second insulative housing 4 comprises a body portion 41 and a tongue portion 42 extending rearwardly from a rear surface of the body portion 41. The tongue portion 42 and the mating portion 12 extend along two opposite directions and offset along an up to down direction. The body portion 41 comprises a plurality of protruding pieces 411 formed on a front surface thereof. The plurality of protruding pieces 411 are arranged along a transversal direction and spaced apart with each other to define a plurality of grooves 412. Each of the groove 412 is formed between two adjacent protruding pieces 411. Each of the protruding piece 411 defines a slot 4111 extending along a vertical direction. The tongue portion 42 defines a plurality of second receiving slots 421 formed on a bottom surface thereof and extending along a mating direction. The plurality of second receiving slots 421 extend throughout the body portion 41 along the mating direction. Thus, a plurality of second openings 413 formed on the front surface of the body portion 41 and located above the plurality of protruding pieces 411. The body portion 41 defines two cooperating portions 43 formed at two sides thereof and cooperated with two mounting portions 13. Each of the cooperating portion 43 defines a depressed section 431 for receiving the mounting portion 13.

Figure 5:
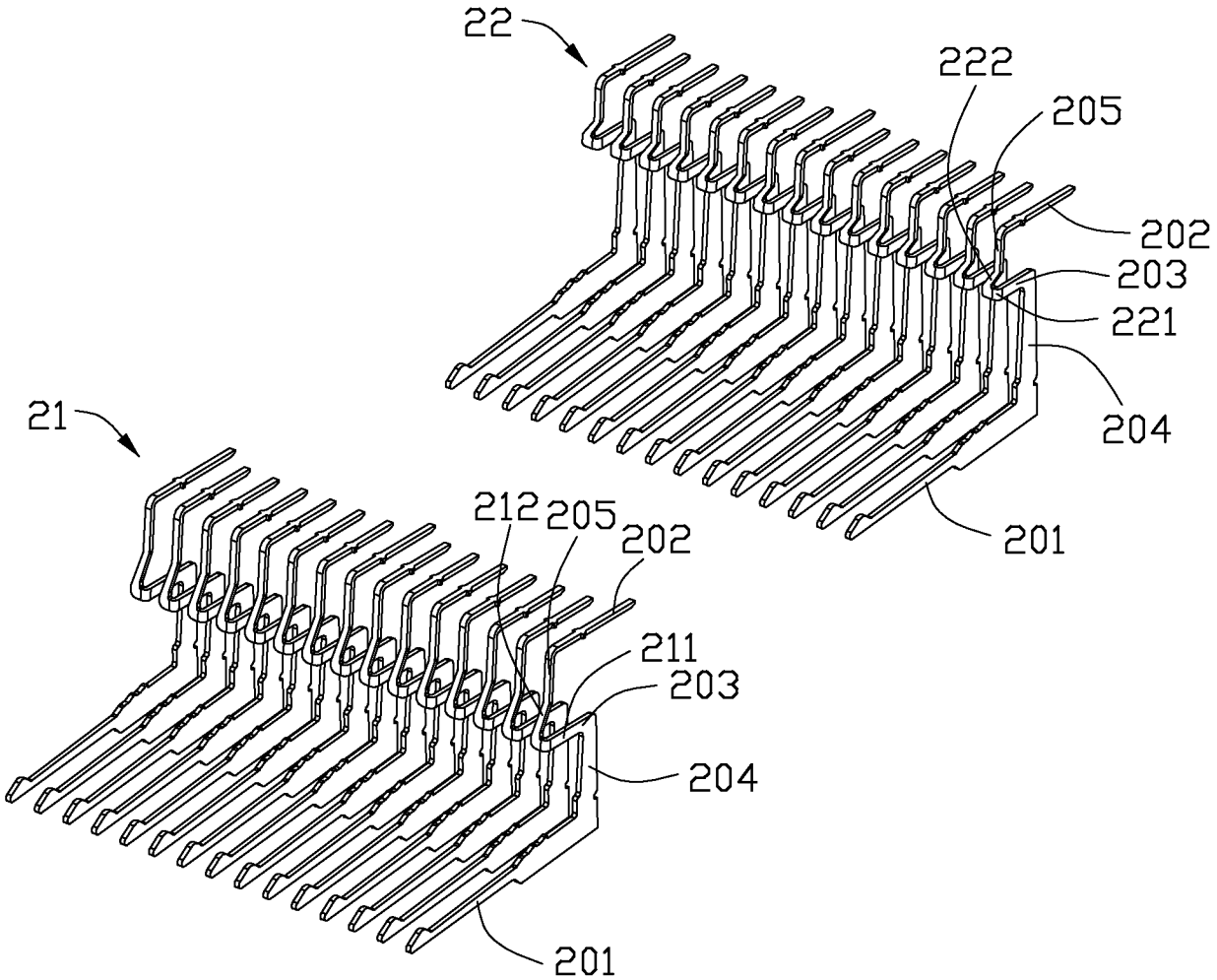
FIG. 5 is a perspective view of a plurality of contacts of the electrical connector assembly of FIG. 1 divided into two rows.

Referring to FIGS. 4 to 5, the plurality of contacts 2 comprises a set of first contacts 21 and a set of second contacts 22. The first contact 21 has a structure different from that of the second contact 22. The plurality of first contacts 21 and second contacts 22 are alternately arranged with respect to each other along a transversal direction. Thus, a first contact 21 is interposed between two adjacent second contacts 22. And, a second contact 22 is interposed between two adjacent first contacts 21. The contact 2 defines a first mating section 201 and a second mating section 202 respectively formed at two sides of the contact 2. The contact 2 further defines an intermediate connecting section comprising an upper vertical segment 205, a lower vertical segment 204, and a horizontal segment 203 connecting with the upper and lower vertical segments 205, 204. The intermediate connecting section is structured in a curved shape. The horizontal segment 203 formed on the first contact 21 is defined as a first horizontal segment 211. The horizontal segment 203 formed on the second contact 22 is defined as a second horizontal segment 221. The first horizontal segment 211 is longer than that of the second horizontal segment 221. The upper vertical segment 205 formed on the first contact 21 is defined as a first upper vertical segment 212. The upper vertical segment 205 formed on the second contact 22 is defined as a second upper vertical segment 222.

Referring to FIGS. 3 to 4, a first metallic shell 3 is structured in a rectangular shape and encloses the first insulative housing 1 and stamped from a metallic sheet. The metallic shell 3 defines a top wall 31 and a lower wall 32 opposite to the top wall 31. The top wall 31 and the lower wall 32 respectively defines two engaging piece 33 formed on a rear end thereof and received into the corresponding apertures 112. Thus, the first metallic shell 3 is engaged to the first insulative housing 1. The top wall 31 defines two slits 311 corresponding to the pair of flutes 123.

Referring to FIGS. 3 to 4, a second metallic shell 5 is structured in a rectangular shape and encloses the second housing 4. The second metallic shell 5 is also stamped from a metallic sheet and defines a receiving room (not labeled) and a top wall 51 and a bottom wall 52. The second metallic shell 5 also defines a plurality of engaging pieces 521 received into the two slots 132 of the first insulative housing 1. Thus, the first and second housing 1, 4 are engaged with each other by the second metallic shell 5. The electrical connector 100 further comprises a metallic connecting piece 6 respectively connected with the first metallic shell 3 and a second metallic shell 5. The metallic connecting piece 6 defines an upright section 60, a front connecting section 62 extending forwardly from a bottom end of the upright section 60 and a rear connecting section 61 extending rearwardly from a top end of the upright section 60. The upright section 60 defines two engaging pieces 601 formed at two sides thereof and inserted into the first housing 1. The front connecting section 62 is attached to the bottom wall 32 of the first metallic shell 3. The rear connecting section 61 is attached to the bottom wall 52 of the second metallic shell 5. The front and rear connecting sections 62, 61 are respectively connected with the first and second metallic shells 2, 5 through soldering process to strengthen the electrical connector 100.

Referring to FIGS. 1 to 5, the assembling process of the electrical connector assembly 100 made in according to the present invention comprising following assembling steps.

As a pitch between two adjacent contacts 2 is smallness, so the contacts 2 are divided into a set of first contacts 21 and a set of second contacts 22 and inserted into the first housing 1 in turn. The set of first contacts 21 is inserted into the first housing 1 firstly. And, the set of second contacts 22 is inserted into the second housing 4 secondly. Obviously, two above assembling steps can be interchanged. The first mating sections 201 of the contacts 2 are received into the plurality of first receiving slots 122. Thirdly, assemble the second metallic shell 5 to the second insulative housing 4. The second insulative housing 4 is enclosed by the second metallic shell 5 Fourthly, assemble the second insulative housing 4 to the first insulative housing 1. And, the second mating sections 202 of the contacts 2 are received into the second receiving slots 421 of the second insulative housing 4. The protrusion 131 of the first insulative housing 1 is received into the depressed section 431 of the second insulative housing 4. The first upper vertical segments 212 of the first contacts 21 are passed through the slots 4111. The second upper vertical segments 222 of the second contacts 22 are passed through the groove 412. Each of the first upper vertical segment 212 is offset to the second upper vertical section 222 along a front to rear direction and a transversal direction. The first upper vertical segments 212 are located in front of the second upper vertical segments 222. Each of the first horizontal segment 211 is offset to each of second horizontal segment 221 along a transversal direction and vertical direction. The second horizontal segments 221 are located above the first horizontal segments 211. Fifthly, assemble the first metallic shell 3 to the first insulative housing 1. The first insulative housing 1 is enclosed by the first metallic shell 3. Sixly, assemble the connecting piece 6 to the first insulative housing 1. The front connecting section 62 is attached to the bottom wall 32 of the first metallic shell 3. The rear connecting section 61 is attached to the bottom wall 52 of the second metallic shell 5. Sevenly, the front connecting section 62 is mechanical connected to the bottom wall 32 of the first metallic shell 3 through soldering process. The rear connecting section 61 is mechanically connected the bottom wall 52 of the second metallic shell 5 through soldering process. Thus, the first metallic shell 3 and the second metallic 5 are connected by the connecting piece 6. After the above assembling steps, the entire process of assembling of the electrical connector assembly 100 is finished.

It should be noted that each of the contact 2 has two mating sections 201, 202 respectively received into the first and second housing 1, 4. So, additional PCB or contact is not essentially existed in the electrical connector 100 for transmitting signal. A total cost of the electrical connector 100 is small. In addition, as the contact 2 is formed integrative, so the signal is transmitted along one contact 2. Thus, the signal transmission of the electrical connector 100 is stability and will not be attenuated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

a first insulative housing having a base portion and a mating portion extending forwardly from the base portion;

a second insulative housing located on the base portion of the first insulative housing, and having a body portion and a tongue portion extending rearwardly from the body portion;

a plurality of contacts in the first and second insulative housings, each of the contacts defining a lower first mating section and an upper second mating section parallel to each other, and an intermediate connecting section connected with the first and second mating sections;

a first metallic shell enclosing and engaged with the first insulative housing;

a second metallic shell enclosing the second insulative housing and engaged with the first insulative housing; and a metallic connecting piece connected with the first and second metallic shells.

2. The electrical connector assembly as recited in claim 1, wherein the mating portion of the first insulative housing defines a receiving room and a plurality of first receiving slots formed in the receiving room, and the first mating sections of the plurality of contacts are received into the first receiving slots.

3. The electrical connector assembly as recited in claim 2, wherein the tongue portion of the second insulative housing defines a plurality of second receiving slots formed on a bottom surface thereof, and the second mating sections of the plurality of contacts are received into second receiving slots.

4. The electrical connector assembly as recited in claim 1, wherein the metallic connecting piece defines two connecting sections at two ends thereof, and the two connecting sections are soldered to the first and second metallic shells.

5. The electrical connector assembly as recited in claim 4, wherein the metallic connecting piece defines two engaging pieces formed at two sides thereof and inserted into the base portion of the first insulative housing.

6. The electrical connector assembly as recited in claim 1, wherein the second metallic shell defines two engaging pieces inserted into the base portion of the first insulative housing.

7. The electrical connector assembly as recited in claim 1, wherein the curved connecting section comprises a lower vertical segment connecting to the first mating section, an upper vertical segment connecting to the second mating section, and a horizontal segment connected with the upper vertical segment and the lower vertical segment.

8. The electrical connector assembly as recited in claim 7, wherein the plurality of contacts are divided into to a set of first contacts and a set of second contacts, the horizontal segment of the connecting section of each first contact is located below the horizontal segment of the connecting section of each second contact, and the upper vertical segment of the connecting section of each first contact is located in front of the upper vertical segment of the connecting section of each second contact.

9. The electrical connector assembly as recited in claim 8, wherein the body portion of the second insulative housing defines a plurality of protruding pieces on a front surface thereof, each of the protruding pieces defines a slot for the upper vertical segment of the connecting section of each first contact to extend through, and the plurality of protruding pieces are arranged along a transversal direction and spaced apart from each other to define a plurality of grooves therebetween for the upper vertical segment of the connecting section of the second contact to extend through.

10. The electrical connector assembly as recited in claim 8, wherein the first contacts and the second contacts are alternately arranged with respect to each other along a transversal direction, a first contact is interposed between two adjacent second contacts, and a second contact is interposed between two adjacent first contacts.

11. A method of assembling an electrical connector, comprising the steps of:

providing a first insulative housing having a plurality first receiving slots, a base portion, and a mating portion;

assembling a plurality of contacts to the first insulative housing, each contact defining a first mating section and a second mating section respectively formed at two ends thereof;

inserting the plurality of first mating sections into corresponding first receiving slots;

providing a second insulative housing having a plurality of second receiving slots, a body portion, and a tongue portion;

assembling a metallic shell to the second insulative housing, the metallic shell defining a plurality of engaging pieces;

assembling the assembled second insulative housing and metallic shell to the first insulative housing, the step of assembling including locating the second insulative housing body portion on the first insulative housing base portion, inserting the engaging pieces of the metallic shell into the base portion of the first insulative housing, and inserting the plurality of second mating sections into corresponding second receiving slots;

assembling another metallic shell to the first insulative housing, the another metallic shell defining a plurality of engaging pieces, the step of assembling comprising inserting the plurality of engaging pieces of the another metallic shell into the base portion of the first insulative housing;

attaching a metallic piece having two connecting sections respectively to the two metallic shells;

soldering the two connecting sections to the two metallic shells.

12. The method of assembling the electrical connector as recited in claim 11, wherein the step of assembling a plurality of contacts to the first insulative housing including mounting a set of first contacts to the first insulative housing and mounting a set of second contacts of the plurality of contacts to the first insulative housing.

13. The method of assembling the electrical connector as recited in claim 12, wherein the steps of mounting comprise arranging the first set of contacts alternately with respect to the second set of contacts along a transversal direction.

14. An adaptor comprising:

an insulative housing including a first mating port and a second mating port facing to different directions; and a plurality of contacts disposed in the housing, each of said contacts unitarily defining a first contacting section exposed in the first mating port and a second contacting section exposed in the second mating port; wherein the first contacting section defines a first mating face on a surface perpendicular to a thickness surface of the first contacting section while the second contacting section defines a second mating face on a surface which is derived from a thickness surface of the second contacting section.

15. The adaptor as claimed in claim 14, wherein a curved section is linked between the first contacting section and the second contacting section.

16. The adaptor as claimed in claim 15, wherein said curved sections are arranged with two rows offset from each other in both a vertical direction and a front to back direction perpendicular to said vertical direction.

17. The adaptor as claimed in claim 16, wherein said curved section extends in a longitudinal direction perpendicular to both said vertical direction and said front-to-back direction.

18. The adaptor as claimed in claim 14, wherein at least either the first contacting sections or the second contacting sections are arranged in one row.

19. The adaptor as claimed in claim 14, wherein said first mating port and the second mating port are made by different parts while assembled to each other to commonly form said housing.

20. The adaptor as claimed in claim 14, wherein said first mating port and said second mating port are opposite to each other while offset from each other in a vertical direction.

* * * * *